United States Patent [19]

Williams

[11] Patent Number: 4,526,413

[45] Date of Patent: Jul. 2, 1985

[54] REMOTE CONTROLLED SELF-POWERED EXCAVATOR APPARATUS

[76] Inventor: Howard G. Williams, 3727 E. Joppa Rd., Baltimore, Md. 21236

[21] Appl. No.: 597,938

[22] Filed: Apr. 9, 1984

[51] Int. Cl.[3] ..... E02F 3/44

[52] U.S. Cl. ..... 294/88; 294/68.23; 294/905; 37/184; 37/DIG. 1

[58] Field of Search ..... 294/70, 88; 37/DIG. 1, 37/183 R, 184, 185, 186, 187, 188, 71, 56; 414/909; 901/36-38; 212/160; 340/685

[56] References Cited

U.S. PATENT DOCUMENTS

| | | | |
|---|---|---|---|
| 2,889,642 | 6/1959 | Stein | 37/71 X |
| 3,310,335 | 3/1967 | Shuey | 294/88 |
| 3,892,079 | 7/1975 | Hirano et al. | 37/DIG. 1 X |
| 4,381,872 | 5/1983 | Hahn | 294/88 X |

FOREIGN PATENT DOCUMENTS

| | | | |
|---|---|---|---|
| 2390363 | 12/1978 | France | 212/160 |

OTHER PUBLICATIONS

U.S. Army Engineer Research and Development Laboratories Publication, "Construction Power", for Nuclear Warfare, 5/24/1957.

*Primary Examiner*—Clifford D. Crowder
*Attorney, Agent, or Firm*—John F. McClellan, Sr.

[57] ABSTRACT

A self-contained system eliminates need for hydraulic or other lines from a crane to a grapple or clamshell bucket on the end of the crane hoist line. A wireless (radio or sonic) portable remote-control unit sends signals to a hydraulic power system carried above the grapple or clamshell bucket, either as an integral part of the bucket or spaced a distance up the line from the bucket suitable for avoiding damage when the grapple or clamshell bucket is used in dredging or is otherwise submerged.

1 Claim, 5 Drawing Figures

REMOTE CONTROLLED SELF-POWERED EXCAVATOR APPARATUS

FIELD OF THE INVENTION

This invention relates generally to hoist line implements and particularly to hydraulic grapples and buckets for use therewith.

BACKGROUND OF THE INVENTION

Problems associated with powering grapples and buckets have included slowness of operation by hydraulic means because of the length of hydraulic lines necessary for extending out from the crane to the end of the hoist line. This awkwardness is compounded in situations exhibiting lack of automatic accommodation of the powered jaws, one to the other in closing on a load.

In the known art, the problem has been eased to some extent by provision of a hydraulic power unit on the top of a hydraulically actuated jaw implement such as a clamshell bucket or grapple, and by hydraulic connection in parallel of respective jaw-operating cylinder assemblies.

Also known in the art is a radio-controllable excavator that can be operated almost submerged in water.

SUMMARY OF THE INVENTION

However, it is believed that a combination of the best features in one economical, practical, use-tested full scale system has not been provided, and to provide such is a principal object of this invention.

Further objects are to provide a system as described that can be used for underwater excavation and material handling without more than the pistons being immersed, that requires no modification of hoist line equipment with which it is used, being instantly put into operation by hanging it on the hook and remotely starting it, controlling jaw opening and closing, and stopping it, as desired.

Yet further objects are to provide a system as described that optionally can be radio controlled or sonically controlled, that is lightweight and compact, that can be transported by dump truck without complicated preparation, or damage, and that is easy to operate and reliable.

Still further objects are to provide a system as described that can easily be interchanged for use with clamshell buckets and with grapples.

In brief summary given as cursive description only and not as limitation, a self-contained system eliminates need for hydraulic or other lines from a crane to a grapple or clamshell bucket on the end of the crane hoist line. A wireless (radio or sonic) portable remote-control unit sends signals to a hydraulic power system carried above the grapple or clamshell bucket, either as an integral part of the bucket or spaced a distance up the line from the bucket suitable for avoiding damage when the grapple or clamshell bucket is used in dredging or is otherwise submerged.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
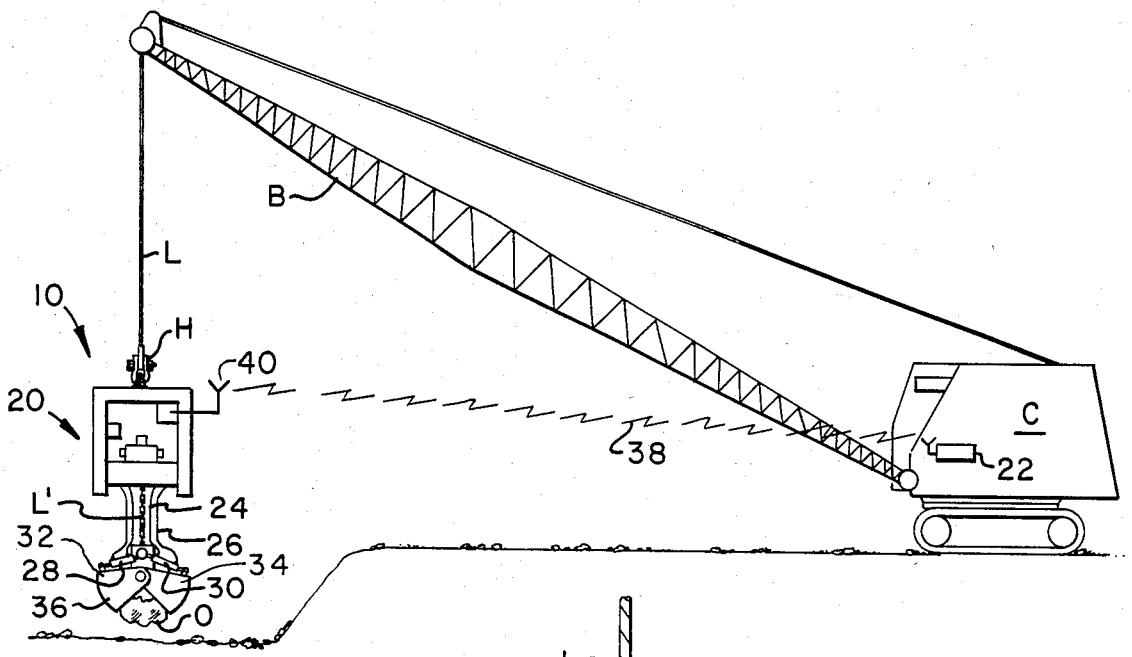
FIG. 1 is a side view of a first embodiment, that could as well employ a grapple; this embodiment is preferred for underwater work.

FIG. 1 shows embodiment 10 of the invention in use with a conventional crane C. The controlled part 20 of the invention hangs on crane shackle or hook H on the hoist line L and the controlling part 22 may lie on a seat or on a shelf near the operator position of the crane. No other installation is required, and the crane is entirely unmodified. The conventional hydraulic and/or electric lines normally seen swinging between crane and load unit (bucket or grapple) are eliminated. The lag in control caused by travel time in the necessarily long hydraulic lines is practically eliminated.

The controlled part 20 of the invention is a selfcontained hydraulic power system that supplies hydraulic pressure and return, as through lines 24, 26 to the characteristic or conventional double-acting hydraulic cylinder assemblies 28, 30 that actuate the jaws 32, 34 of the clamshell bucket 36. The bucket could as well be a grapple, and the object O lifted could be riprap or any other load.

The controlling part 22 is a transmitter.

Either radio or sonic control may be used, both being called "wireless" for purposes of this application. Either type can produce a signal 38 to be received by an equivalent type receiver, pickup shown at 40, and cause the hydraulic power system to start up, to open and to close the jaws 32, 34 and to stop operating.

Operating height adjustments of the hook, and operating locations are provided by operation of the crane in conventional manner.

The free-hanging spacing of the hydraulic power system 20 above the bucket 36 permits the bucket and the length of line L' (which may be a chain) between to be immersed without damage to the hydraulic power system 20, for underwater work. Twenty or thirdy feet (6 to 9 meters) of line or more can be used, depending on clearance beneath the boom B, although operation may be slowed by longer lengths.

The hydraulic power unit is light enough in weight relative to the remainder of the load on the hoist line, so that double-swing type oscillations are easily avoided by the crane operator.

Figure 2:
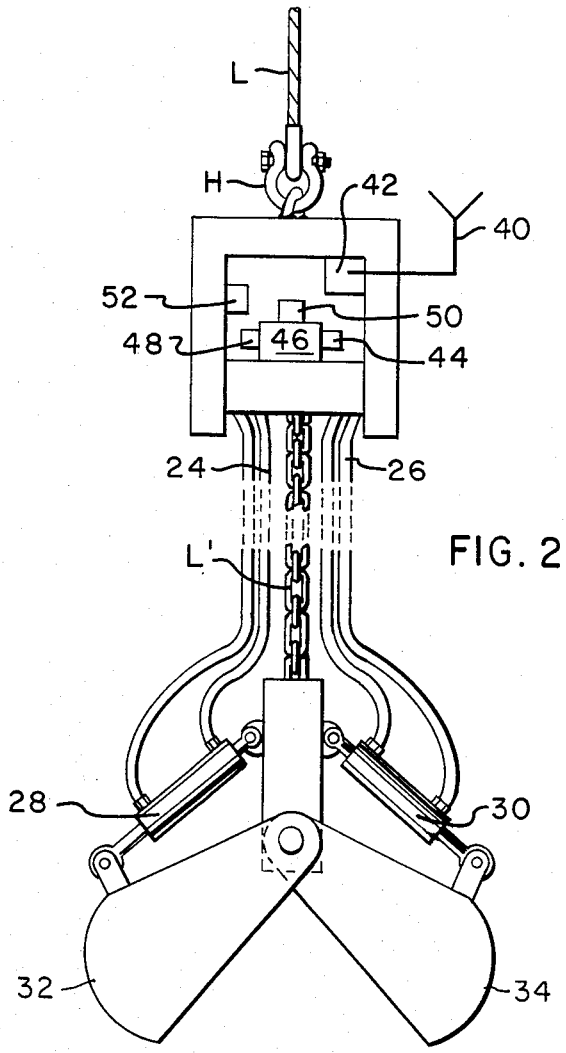
FIG. 2 is a diagrammatic view of elements of the first embodiment in use for underwater work.

FIG. 2 diagrams the hydraulic power system in more detail.

In typical sequence, receiver/amplifier 42 for the incoming signals responds by actuating a typical solenoid for electric starter 44 which starts gasoline engine 46 that in turn drives hydraulic pump 48 that supplies hydraulic fluid at operating pressure to the system, which may include a conventional accumulator 50. When signalled, solenoid valve 52 supplies hydraulic pressure through lines 24, 26 to the hydraulic cylinders 28, 30 shown, that control opening and closing of the jaws 32, 34.

When the work is done, a signal transmitted by the operator and received, turns off the ignition of engine 46 and causes the system to stop. The hydraulic system is conventional in itself and may include suitable check valves and other provisions known to those skilled in the art.

Figure 3:
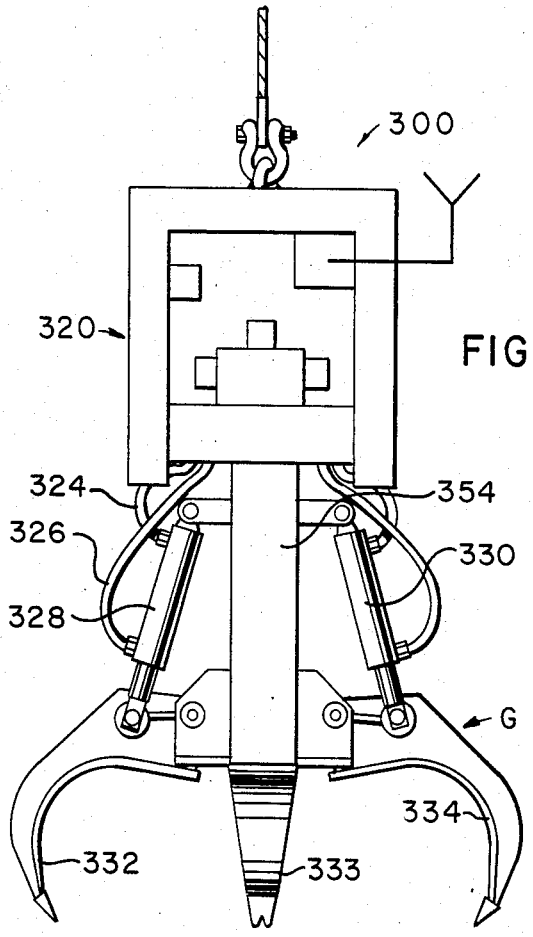
FIG. 3 is a diagrammatic view of a second embodiment, tha could as well employ a clamshell.

FIG. 3 diagrams the invention in a second embodiment 300 characterized by the mounting of the hydraulic power unit 320 directly on the frame 354 of a conventional grapple G or other such device.

Hydraulic pressure is supplied as before, and through lines as at 324, 326 and cylinder assemblies 328, 330 shown, powers the jaws 332, 333, 334. Compactness is a useful feature of this embodiment, and there may be less tendency to oscillate than in the FIG. 1 embodiment. The hydraulic lines may be hooked in parallel with substantially pressure-free return, for accommodative action in the jaws.

Figure 4:
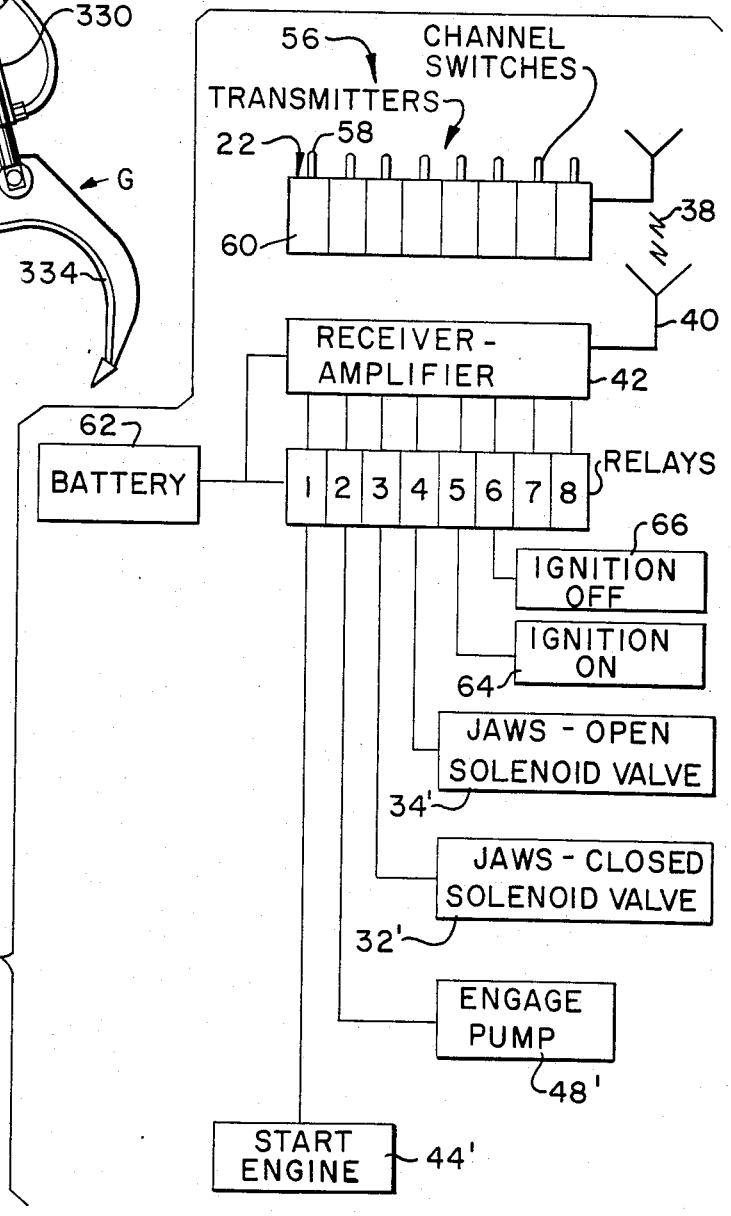
FIG. 4 is a block diagram of a radio control system.

FIG. 4 diagrams a radio circuit 56 for control. Appropriate conventional switches such as toggle switches 58 respectively control a plurality of transmitter channels 60 of different frequencies, in accordance with conventional practice.

These switches may, but need not essentially, be conventionally interlocked to prevent conflicting signals from being transmitted.

The transmitter has an internal battery, and battery 62 powers the controlled portion 20 of the system.

The transmitted signals are received and amplified by receiver-amplifier 42. A signal 38 received on the frequency corresponding to that provided to control turn-on of the ignition of the engine as at 64 would, for example, close relay 5, which could have a self-locking coil circuit. Relay 1 would respond to signal from the corresponding transmitter channel and with starter 44′ start the engine. Actuation of other switches would similarly close relays 2 (engage pumps at 48′) 3 (close jaws as at 32′) 4 (open jaws as at 34′) and 6 (ignition off as at 66 by releasing the self-locking circuit of relay 5).

Another suitable excavator hydraulic circuit with radio control is disclosed in U.S. Pat. No. 3,892,079 issued to K. Hirano on 7-1-75. In this, a hydraulic system responds to radio signals to open and close selected valves that control pressure to hydraulic cylinder assemblies used to actuate mechanisms of the excavator.

The system disclosed in that patent is hereby incorporated and made a part of this disclosure.

Figure 5:
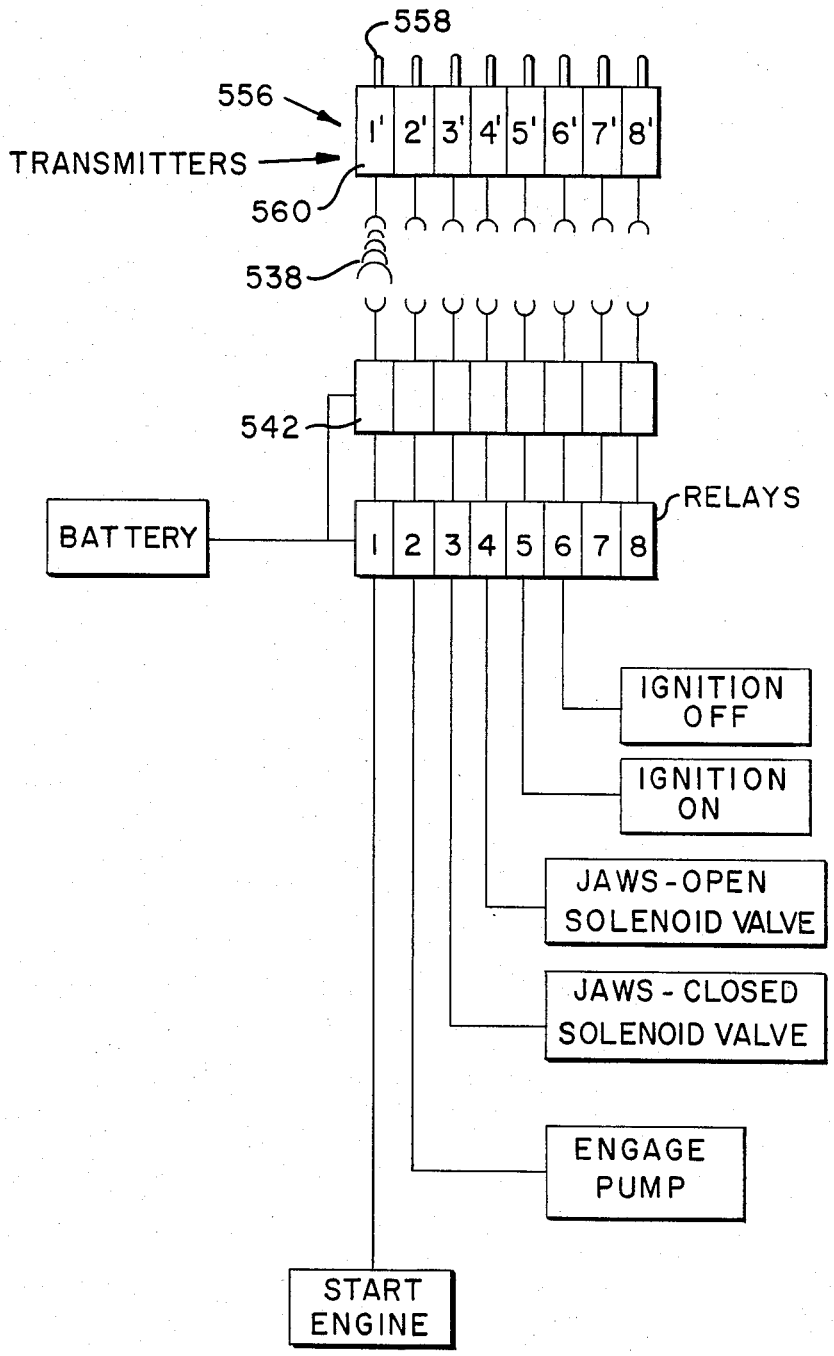
FIG. 5 is a block diagram of a sonic control system.

FIG. 5 diagrams a sonic control system 556 that would operate analogously to the FIG. 4 system. A bank of garage-door-control type sonic transmitters 560 of different frequencies is controlled by respective switches 558 to emanate sound 538 to receivers of receiver-transducer-amplifier 542 that controls relays 1 through 8 selected in correspondence with the frequencies. The relays use battery power in the secondary circuits to actuate the various function controls described in reference to FIG. 4.

Extra channels as shown at 7 and 8 in FIGS. 4 and 5 may be provided to control any other functions desired, such as pre-heaters for the engine or the hydraulic fluid.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a hoist line system with an operator control position thereon, remote from a frame with jaws on an end of said hoist line, and a conventional hydraulic power system with internal combustion engine and pump connected thereto, adjacent the frame and connected for responsively operating said jaws, the improvement comprising in combination: remote radio control means including a receiver adjacent the frame for controlling starting and stopping of the internal combustion system and operating the jaws for minimizing response time for operating the jaws while preserving advantages of said conventional hydraulic power system responsive operation, including means permitting use of said frame and jaws immersed in water free of injury to the receiver, internal combustion engine and pump, comprising said hydraulic power system free hanging on said hoist line in spaced relation above said frame, and a flexible elongate member connecting said hydraulic power system with said frame and providing said spaced relation.

* * * * *